US011768012B2

(12) United States Patent
Rendall et al.

(10) Patent No.: US 11,768,012 B2
(45) Date of Patent: Sep. 26, 2023

(54) HYDRAULICALLY OPENED CONE VERTICAL TUBE DIFFUSER WITH SLANTED ANTI-SIPHON HOLE

(71) Applicant: UT-BATTELLE, LLC, Oak Ridge, TN (US)

(72) Inventors: Joseph D. Rendall, Oak Ridge, TN (US); Kyle R. Gluesenkamp, Knoxville, TN (US); Anthony C. Gehl, Knoxville, TN (US); Jerald A. Atchley, Oak Ridge, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 200 days.

(21) Appl. No.: 17/193,344

(22) Filed: Mar. 5, 2021

(65) Prior Publication Data

US 2022/0136735 A1 May 5, 2022

Related U.S. Application Data

(60) Provisional application No. 63/107,651, filed on Oct. 30, 2020.

(51) Int. Cl.
*F24H 9/00* (2022.01)
*F24H 9/20* (2022.01)
(Continued)

(52) U.S. Cl.
CPC ..... *F24H 9/0015* (2013.01); *F24H 1/186* (2013.01); *F24H 9/133* (2022.01); *F24H 9/2035* (2013.01); *F28D 2020/0069* (2013.01)

(58) Field of Classification Search
CPC ..... F24H 9/0015; F24H 9/133; F24H 9/186; F24H 9/2035; F24H 9/0021; F24H 9/001
(Continued)

(56) References Cited

U.S. PATENT DOCUMENTS 1,716,692 A * 6/1929 Gundlach ..... F16K 15/063 126/362.1
2,123,809 A * 7/1938 Seitz ..... F24H 9/133 126/362.1
(Continued)

FOREIGN PATENT DOCUMENTS

EP 0881438 A2 12/1998

OTHER PUBLICATIONS https://www.cibsejournal.com/cpd/modules2011-08; Aug. 2011.
(Continued)

*Primary Examiner* — Steven S Anderson, II
*Assistant Examiner* — Kurt J Wolford
(74) *Attorney, Agent, or Firm* — FOX ROTHSCHILD LLP

(57) ABSTRACT

A diffuser for a water heater fill tubes having a tube wall with an outside diameter. The diffuser includes an elongated flexible diffuser body for positioning at the outlet end of the fill tube. The diffuser body has a sealing end for sealing with an outside surface of the fill tube wall closest to the inlet end of the fill tube, and an open end for positioning at an end closest to the outlet end of the fill tube. The open end has a diameter larger than an outside diameter of the tube wall, thereby creating an diffuser water outlet opening between the diffuser body and the tube wall for redirecting radial water flow emanating from the fill tube water outlet opening(s) toward the diffuser outlet opening. A fill tube assembly for a water heater, a water heater, and a method for heating water are also disclosed.

24 Claims, 20 Drawing Sheets

(51) Int. Cl.
*F24H 1/18* (2022.01)
*F24H 9/13* (2022.01)
*F28D 20/00* (2006.01)

(58) Field of Classification Search
USPC ..... 122/14.31, 14.3
See application file for complete search history.

(56) References Cited

U.S. PATENT DOCUMENTS 2,294,163 A * 8/1942 Donnelly ..... F24H 1/186 122/504
3,285,241 A 11/1966 Bordeaux
3,514,034 A * 5/1970 Cushman ..... F24D 3/02 237/63
3,674,179 A 7/1972 Galloway
3,726,475 A * 4/1973 Eising ..... F24H 9/133 236/102
3,762,395 A * 10/1973 Taylor ..... F24H 9/133 122/17.1
4,898,150 A * 2/1990 Lewis ..... F24H 9/133 122/19.1
4,949,680 A 8/1990 Kale
4,964,394 A * 10/1990 Threatt ..... F24H 9/133 137/433
5,046,529 A * 9/1991 Corella ..... E03B 11/06 137/592
5,137,053 A 8/1992 Kale
5,365,891 A 11/1994 Hanning
5,421,404 A * 6/1995 Kale ..... F24H 9/133 126/362.1
5,988,117 A * 11/1999 Lannes ..... F24H 9/133 122/159
6,138,614 A 10/2000 Shropshire
6,935,280 B1 * 8/2005 Scott ..... F24H 9/133 122/13.3
7,203,418 B1 * 4/2007 York ..... F24H 1/202 392/441
7,275,504 B2 * 10/2007 Schaeche ..... F28D 20/0034 122/15.1
10,094,592 B2 * 10/2018 Lowdermilk ..... F24H 9/133
10,215,445 B1 * 2/2019 Mottershead ..... F24H 9/133
10,288,316 B1 * 5/2019 Currey ..... F24H 9/45
2002/0050478 A1 * 5/2002 Talbert ..... F28D 7/106 210/931
2010/0034528 A1 * 2/2010 Willis ..... F24H 9/0021 392/451
2011/0247572 A1 * 10/2011 Smith ..... F24H 1/205 122/19.1
2017/0211843 A1 * 7/2017 Wu ..... F28D 7/14
2019/0137189 A1 * 5/2019 Teng ..... F24D 12/02

OTHER PUBLICATIONS

F. J. Oppel, A. J. Ghajar, and P. M. Moretti, "Computer simulation of stratified heat storage," Appl. Energy, vol. 23, No. 3, pp. 205-224, 1986.
Lavan and J. Thompson, "Experimental study of thermally stratified hot water storage tanks," Sol. Energy, vol. 19, No. 5, pp. 519-524, 1977.
A. Bejan, "Buckling flows: a new frontier in fluid mechanics," Annu. Rev. Heat Transf., vol. 1, No. 1, pp. 262-304, Mar. 1987.

* cited by examiner

HYDRAULICALLY OPENED CONE VERTICAL TUBE DIFFUSER WITH SLANTED ANTI-SIPHON HOLE

CROSS-REFERENCE TO RELATED APPLICATIONS

This application claims priority to U.S. Provisional Patent Application No. 63/107,651 filed on Oct. 30, 2020, entitled "HYDRAULICALLY OPENED CONE VERTICAL TUBE DIFFUSER WITH SLANTED ANTI-SIPHON HOLE", the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates generally to water heaters, and more particularly to fill tubes for water heaters.

BACKGROUND OF THE INVENTION

Hot water heaters of the tank type store water in the tank and heat the water to a set point temperature using electric heating elements or gas burners. Water with the highest temperature accumulates toward the top of the tank due to the differing density of water with temperature. As hot water is withdrawn from the top of the tank, the user will notice a reduction of water temperature during long periods of use. The industry metric that captures the ability of hot water tanks to deliver hot water is called the first-hour rating (FHR). The mixing of heated water within the tank with cold water being added to the tank decreases the temperature of the hot water already heated. During long periods of use, there comes a point when the heating elements, during the final stages of an FHR test, can no longer maintain the required set temperature. Because the tank is stratified by density, there is more hot water available towards the end of the test when there is no mixing at the inlet. Water during a drawn at a rate below what can be continuously heated to the cut-off temperature required by the FHR, results in a reduced FHR rating. Also, the mixing of heated water within the tank with cold water being added to the tank decreases the contact time of the heating elements with the coldest water, slowing replenishment of the hot water. The FHR of hot water tanks can be increased by reducing the mixing of the water within the tank.

SUMMARY OF THE INVENTION

A fill tube assembly for a water heater includes an elongated fill tube having an interior water flow axis and a tube wall with an inlet end and an outlet end, and an open interior communicating with a water inlet opening at the inlet end and with at least one fill tube water outlet opening in the tube wall for directing water radially outward from the fill tube. An elongated diffuser body at the outlet end of the fill tube seals with an outside surface of the tube wall at a sealing end closest to the inlet end of the fill tube, and has an open end at an end closest to the outlet end of the fill tube.

The open end has a diameter larger than an outside diameter of the tube wall, thereby creating an diffuser water outlet opening between the diffuser body and the tube wall for redirecting radial water flow emanating from the fill tube water outlet opening toward the diffuser outlet opening.

The diffuser body can be conical. The fill tube can include a plurality of fill tube water outlet openings axially spaced apart at the outlet end of the fill tube. The fill tube water outlet openings can decrease in diameter toward the outlet end of the fill tube. The fill tube water outlet openings can have an axis between 10 and 80 degrees to the water flow axis of the fill tube. The fill tube water outlet openings can be oriented distally toward the outlet end of the fill tube and diffuser water outlet opening. The fill tube water outlet openings nearest the outlet end of the fill tube can be oriented between 90 and 170 degrees relative to the interior water flow axis of the fill tube. The distance travelled by water leaving the fill tube water outlet openings to reach the diffuser body can decrease with the distance from the outlet end of the fill tube.

The fill tube can include an antisiphon water outlet opening at the inlet end of the fill tube. The siphon water outlet opening has an axis, and the axis of the antisiphon opening can be between 100 and 170 degrees to the interior water flow axis of the fill tube.

The sealing end of the diffuser can include a detachable connection to the fill tube. The detachable connection can be an elastic band. The sealing end can include a fastener for affixing the sealing end to the fill tube.

The diffuser water outlet opening can be annular. The diffuser water outlet opening can be other shapes. The fill tube assembly can further include an attachment seam between the fill tube and the diffuser body. The attachment seam can be elongated and extending longitudinally down the fill tube.

The diameter of the diffuser water outlet opening can be 1.5 to 20 times larger than the diameter of the fill tube. The fill tube can have between 1 and 20 fill tube water outlet openings. The sum of the cross sectional areas of the water outlet openings can be larger than the cross sectional area of the open interior of the fill tube. The diffuser body can include shape memory high temperature silicone. Other materials are possible. The outlet end of the fill tube can be plugged.

A water heater can include a tank having a top, bottom and sides, with a tank water inlet and a tank water outlet. An elongated fill tube is connected to the tank water inlet and can have an interior water flow axis and a tube wall with an inlet end and an outlet end. An open interior communicates with a water inlet opening at the inlet end and at least one fill tube water outlet opening in the tube wall for directing water radially outward from the fill tube.

An elongated diffuser body is provided at the outlet end of the fill tube. The diffuser body seals with an outside surface of the tube wall at an end closest to the inlet end, and has an open end at an end closest to the outlet end of the fill tube. The open end has a diameter larger than an outside diameter of the tube wall, thereby creating an diffuser water outlet opening between the diffuser body and the tube wall for redirecting radial water flow emanating from the fill tube water outlet opening toward the diffuser water outlet opening. The longest distance from the diffuser water outlet opening to a bottom of the tank can be between $\pi D_D/4$ and $\pi D_D/2$, where $D_D$ is the diameter of the open end of the diffuser.

A method of heating water with a water heater can include the step of providing a water heater as described. Water is supplied to the water heater through the tank water inlet and the elongated fill tube, wherein water will emerge from the fill tube and be direct by the diffuser body to the diffuser water outlet opening. Heated water can be removed from the tank water outlet.

The diffuser body can be retrofitted to an existing fill tube by removing an existing water heater fill tube from the water heater, placing the diffuser onto the fill tube adjacent the outlet end, flexing the diffuser body to a contracted state, and placing the fill tube and the diffuser into the water heater tank. The fill tube with the diffuser body can be retrofitted to an existing water tank by removing an existing water heater fill tube from the water heater, providing a fill tube with a diffuser, flexing the diffuser body to a contracted state, and placing the fill tube and the diffuser into the water heater tank.

A diffuser for a water heater fill tube can have a tube wall with an outside diameter. The diffuser includes an elongated flexible diffuser body for positioning at the outlet end of the fill tube. The diffuser body can have a sealing end opening for mating and sealing with an outside surface of the tube wall at the sealing end closest to the inlet end of the fill tube, and can have an open end for positioning at an end closest to the outlet end of the fill tube. The open end can have a diameter larger than an outside diameter of the tube wall, thereby creating an diffuser water outlet opening between the diffuser body and the tube wall for redirecting radial water flow emanating from the fill tube water outlet opening toward the diffuser outlet opening.

The diffuser can further include weights at the open end for maintaining the diffuser open end in an open configuration. The diffuser can include a plurality of flexible ribs spaced apart on the flexible body, the ribs having an elasticity less than the elasticity of the diffuser body.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
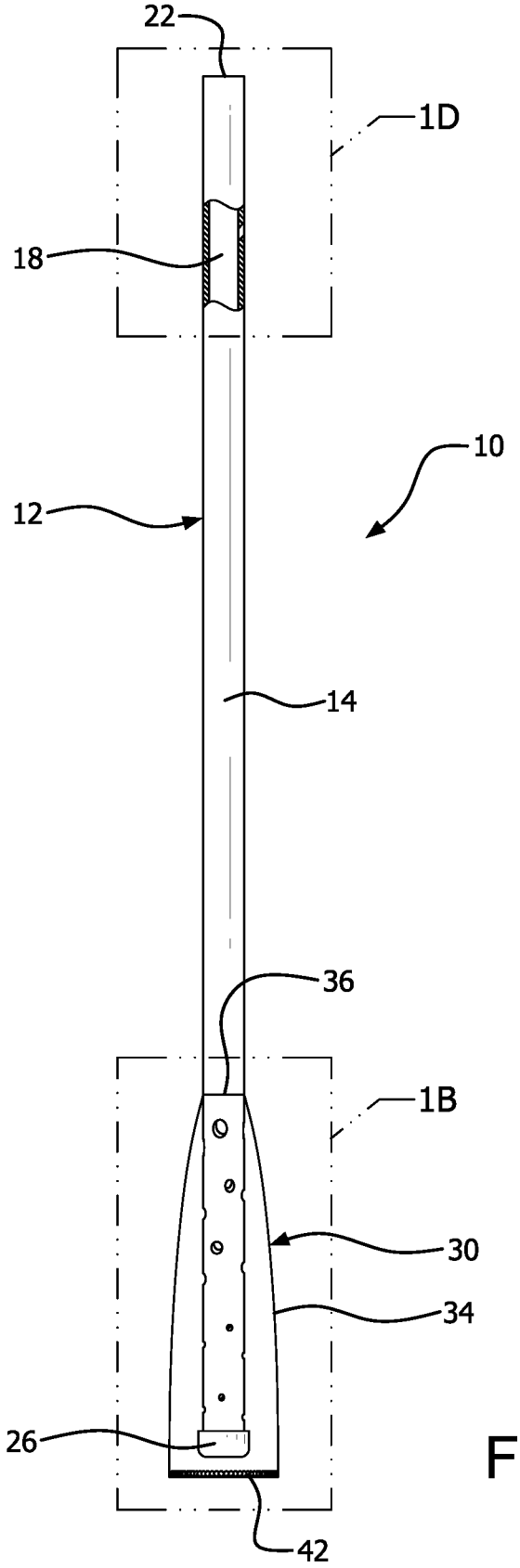
FIG. 1 is a schematic side elevation, partially broken away, of a fill tube and diffuser assembly according to the invention.

A fill tube assembly for a water heater includes an elongated fill tube having a water flow axis and a tube wall with an inlet end and an outlet end. The fill tube has an open interior communicating with a water inlet opening at the inlet end and with at least one fill tube water outlet opening in the tube wall for directing water radially outward from the fill tube. A diffuser with an elongated diffuser body is provided at the outlet end of the fill tube. The diffuser body seals with an outside surface of the tube wall at a sealing end closest to the inlet end of the fill tube. The diffuser body has an open end at an end closest to the outlet end of the fill tube. The open end has a diameter larger than an outside diameter of the tube wall, thereby creating a diffuser water outlet opening between the diffuser body and the tube wall for redirecting radial water flow emanating from the fill tube water outlet openings toward the diffuser outlet opening. The outlet end of the fill tube can be plugged.

The diffuser body contains and redirects water flow from the fill tube water outlet openings into a larger enclosed space formed by the diffuser body. The flow area that should be provided by the diffuser water outlet opening for non-turbulent flow is a function of the interior flow diameter of the fill tube which can be denoted as $D_{FT}$, and also the diameter of the diffuser water outlet opening which can be denoted as $D_D$. The relationship between the $D_{FT}$ and $D_D$ for complete laminarization of flow depends on the length of the expanded section, as well as $D_D$ and $D_{FT}$. For a round tube expanding to a cone shape, the length L required for complete laminar flow to be achieved is between 10-100 times the $D_{FT}$. Similarly, for noncircular expanders the relationship is expanding the cross-section area gradually, but no simple correlation exists. It is known from the Bernoulli principle of fluid dynamics that as the flow area expands, the velocity of the flowing liquid will decrease. The Bernoulli energy balance requires that the velocity pressure of the liquid must decrease as the flow area increases, and the static pressure will increase. If the flow becomes turbulent, where the Reynolds number is greater than 2300 for round tubes, unwanted mixing will occur within the tank due to turbulent eddies. However, if the Reynolds number is reduced to below 2,300 due to an increase in the cross sectional area, then laminar flow will predominate. The length L required for complete laminar flow to be achieved is between 10-100 times the $D_{FT}$ for round tubes expanding to a cone shape. Thereby, fill tube water outlet openings that have a greater distance to the diffuser water outlet opening can have a higher flowrate, travel a longer distance in which laminarization can occur, and a larger diameter than those that are closer to the diffuser water outlet opening.

The cross sectional area of the diffuser water outlet opening should be larger the cross sectional area of the fill tube. The cross sectional area of the diffuser water outlet opening can be from 1.01-1000 times larger than the cross sectional area of the fill tube. The cross sectional area of the diffuser water outlet opening can be 1.01, 5, 10, 15, 20, 25, 30, 35, 40, 45, 50, 55, 60, 65, 70, 75, 80, 85, 90, 95, or 100 times larger than the cross sectional area of the fill tube, or within a range of any high value and low value selected from these values.

The sum of the cross sectional areas of the fill tube water outlet openings should be larger than the cross sectional area of the open interior of the fill tube. The sum of the cross sectional areas of the fill tube water outlet openings should be 1.01, 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, or 20 times larger than the cross sectional area of the open interior of the fill tube, or within a range of any high value and low value selected from these values.

The diffuser body can have any suitable shape to create expansion. The diffuser body can be conical. The conical shape offers an expanding cross sectional area in the direction of the diffuser water outlet opening, without corners and edges that could create turbulence. The distance travelled by water leaving the fill tube water outlet openings to reach the diffuser body decreases with the distance from the outlet end of the fill tube. Other shapes of gradual expansion of cross sectional area are possible.

The fill tube is generally elongated and positioned in the water tank so as to deliver water to a bottom portion of the tank such that only heated water is withdrawn from the water outlet of the water tank, which is usually at the top of the water heater tank. The fill tube has a plurality of fill tube water outlet openings axially spaced apart at the outlet end of the fill tube. The fill tube water outlet openings can decrease in diameter in the direction toward the outlet end of the fill tube. The size and number of the fill tube water outlet openings can vary.

The fill tube water outlet openings can be angled relative to the interior water flow axis of the fill tube. The fill tube water outlet openings can have an axis between 10 and 80 degrees to the long axis of the fill tube. This will direct the water outward toward the diffuser body, and also toward the diffuser water outlet opening. The angle of the fill tube water outlet openings relative to the water flow axis of the fill tube can be 10, 15, 20, 25, 30, 35, 40, 45, 50, 55, 60, 65, 70, 75 or 80 degrees, or can be within a range of any high value and low value selected from these values.

The fill tube water outlet openings located nearest the outlet end of the fill tube can be oriented differently than the fill tube water outlet openings further from the outlet end of the fill tube, and can be angled more toward the fill tube inlet. This will help to push out the diffuser body and hold the diffuser water outlet opening in an expanded condition. The distal water outlet openings between 90 and 170 degrees relative to the water flow axis of the fill tube, and towards the inlet end of the fill tube. The fill tube water outlet openings nearest the outlet end of the fill tube can oriented relative to the axis of the fill tube 90, 95, 100, 105, 110, 115, 120, 125, 130, 135, 140, 145, 150, 155, 160, 165, or 170 degrees, or within a range of any high value and low value selected from these values.

The fill tube can include an antisiphon water outlet opening at the inlet end of the fill tube. The antisiphon water outlet opening has an axis relative to the water flow axis of the fill tube between 100 and 170 degrees, such that water leaving the antisiphon opening is directed more toward the inlet end of the fill tube. The angle of the axis of the antisiphon water flow outlet opening to the interior water flow axis of the fill tube can be 100, 105, 110, 115, 120, 125, 130, 135, 140, 145, 150, 155, 160, 165, and 170 degrees, or within a range of any high value and low value selected from these values. Directing the axis of water flow from the antisiphon openings somewhat counter to the water flow axis of water flow through the fill tube will reduce the amount of water flowing from the antisiphon opening in the normal state of operation, reducing the mixing of cold water entering the tank through the fill tube with hot water at the top of the tank.

The diffuser body can be connected to the fill tube by any suitable means. The sealing end of the diffuser can have a detachable connection to the fill tube. The detachable connection is an elastic band. Other connecting structure, for example hose clamps, are possible. The sealing end can be secured to the fill tube with a fastener for affixing the sealing end to the fill tube. The diffuser is some instances be formed integrally with the fill tube, as by machining, welding, casting or molding.

The diffuser water outlet opening can take any suitable shape. The diffuser water outlet opening can be circular. The diffuser water outlet opening can be annular with the fill tube. There can be an attachment seam between the fill tube and the diffuser body, the attachment seam being elongated and extending longitudinally down the fill tube such that the flexible diffuser body will depend from the fill tube.

The diffuser body can be formed from different material or the same material as the fill tube. The diffuser body can be formed from a flexible material. The flexible material can be high temperature silicone. The diffuser body can be formed from a shape memory material such as a shape memory plastic.

A water heater according to the invention can include a tank having a top, bottom and sides, with a tank water inlet and a tank water outlet. An elongated fill tube is connected to the tank water inlet and has a long water flow axis, a tube wall, and an inlet end and an outlet end. An open interior communicates with a water inlet opening at the inlet end and at least one fill tube water outlet opening in the tube wall for directing water radially outward from the fill tube at the outlet end. A diffuser with an elongated diffuser body is provided at the outlet end of the fill tube. The diffuser body seals with an outside surface of the tube wall at an end closest to the inlet end, and has an open end at an end closest to the outlet end of the fill tube. The open end has a diameter larger than an outside diameter of the tube wall, thereby creating an diffuser water outlet opening between the diffuser body and the tube wall for redirecting radial water flow emanating from the fill tube water outlet opening toward the diffuser water outlet opening.

The positioning of the diffuser body relative to the bottom of the water tank can vary. In one embodiment, the longest distance from the diffuser water outlet opening to a bottom of the tank is between $\pi D_D/4$ and $\pi D_D/2$, where $D_D$ is the diameter of the open end of the diffuser.

A method of heating water with a water heater, includes the steps of providing a water heater according to the invention, supplying water to the water heater through the tank water inlet and an elongated fill tube assembly with a diffuser having an elongated diffuser body. Water will emerge from the fill tube and be directed by the diffuser body to a diffuser water outlet opening. The heated water can then be removed from the tank water outlet. In addition to this, hot water could enter through the outlet and cold water drawn from the long diffuser tube in a recirculation loop where an external heat source is heating the water. This is when no hot water is needed by the user and the tank is recovering to a hot state. This would be a method that would reduce the mixing in the tank during recharge. Furthermore, a short expanding dip tube (<9 inches long) may be used at the top of the tank at another inlet point, for the hot water to reduce mixing also.

The diffuser body can be retrofitted to an existing fill tube by removing an existing water heater fill tube from a water heater, placing the diffuser onto the fill tube adjacent the outlet end, such that an end of the diffuser body closest to the inlet end of the fill tube seals against the fill tube. The diffuser body is flexed or squeezed to a contracted state. The fill tube and the diffuser are positioned into the water heater tank and connected, whereupon the diffuser body will return to an expanded state. The fill tube with the diffuser body can be thereby retrofitted to an existing water tank by removing an existing water heater fill tube from the water heater, providing a fill tube with a flexible diffuser, flexing the diffuser body to a contracted state, and placing the fill tube and the diffuser into the water heater tank.

A diffuser for a water heater fill tube having a tube wall with an outside diameter, includes an elongated flexible diffuser body for positioning at the outlet end of the fill tube. The diffuser body has a sealing end for mating and sealing with an outside surface of the tube wall at the sealing end closest to the inlet end of the fill tube, and can have an open end for positioning at an end closest to the outlet end of the fill tube. The open end can have a diameter larger than an outside diameter of the tube wall, thereby creating an diffuser water outlet opening between the diffuser body and the tube wall for redirecting radial water flow emanating from the fill tube water outlet opening toward the diffuser outlet opening.

The diffuser can have additional structure to insure that the diffuser retains an appropriate shape in the water tank. The diffuser can include weights at the open end for maintaining the diffuser open end in an open configuration. The diffuser can include a plurality of flexible ribs circumferentially spaced apart on the flexible body and extending down the elongated diffuser body. The ribs having an elasticity less than the elasticity of the diffuser body, and act as a spring to open the diffuser body to an expanded state and to maintain the diffuser body in the expanded state, while permitting contraction of the diffuser body during installation. Other structure is possible.

There is shown in FIG. 1 a fill tube assembly 10 according to the invention. The fill tube assembly includes a fill tube 12 and a diffuser 30. The fill tube 12 includes an elongated fill tube 14 with an open interior 18, an inlet end 22 and an outlet end 26. The diffuser 30 can include a diffuser body 34 with a sealing end 36 closest to the inlet end 22 of the fill tube 14. The diffuser body 34 can further include an open end 42 that is positioned adjacent to the outlet end 26 of the fill tube 14.

Figure 1A:
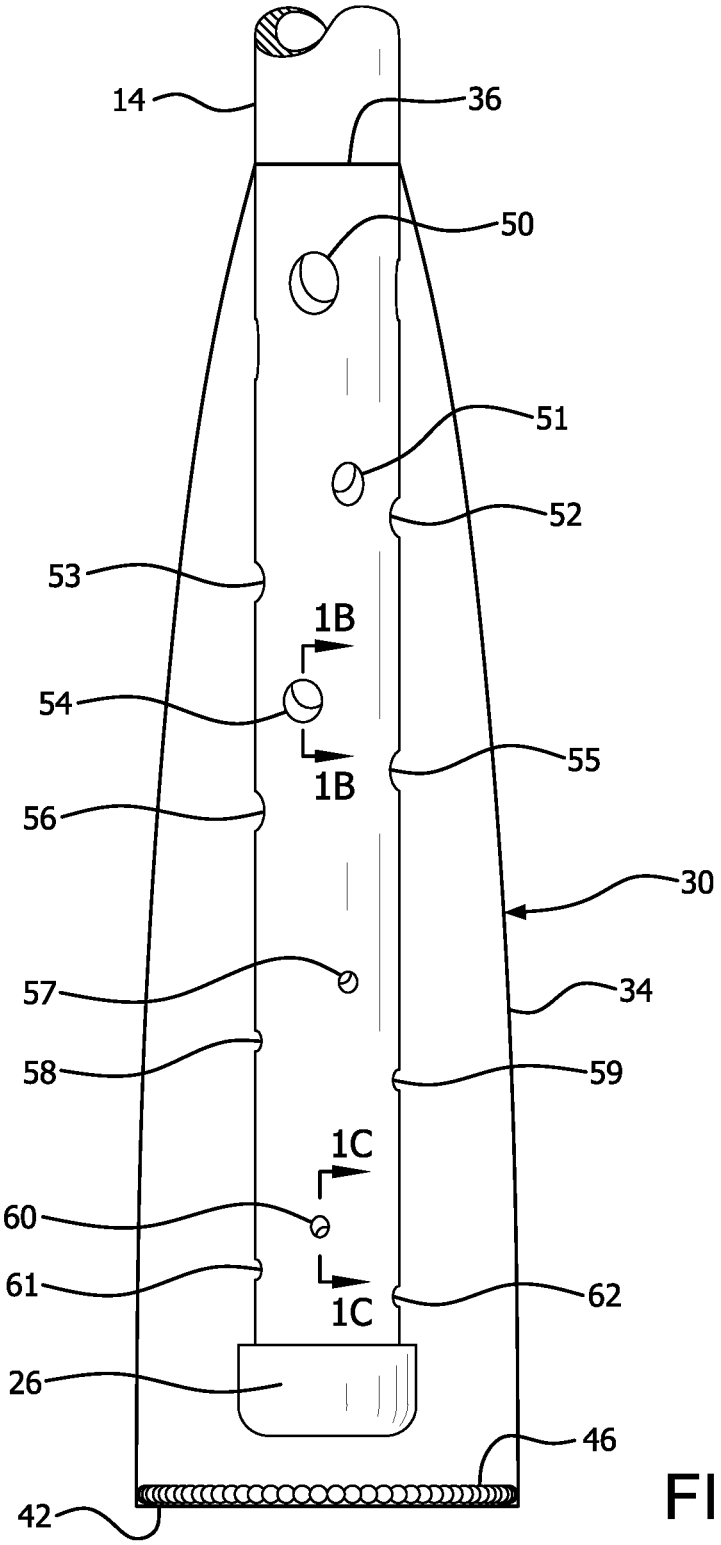
FIG. 1A is an enlargement of area 1A in FIG. 1.

There is shown in FIG. 1A a plurality of fill tube water outlets 50-62. More or fewer outlets are possible. The end 26 of the fill tube 14 is typically plugged and all water emanates from outlet openings in the side wall of the fill tube 14 near the outlet end 26. The flexible body 34 can have weights 46 at the open end 42 to help to maintain the open end 42 in an expanded condition to permit the outflow of water from the diffuser body 34.

Figure 1B:
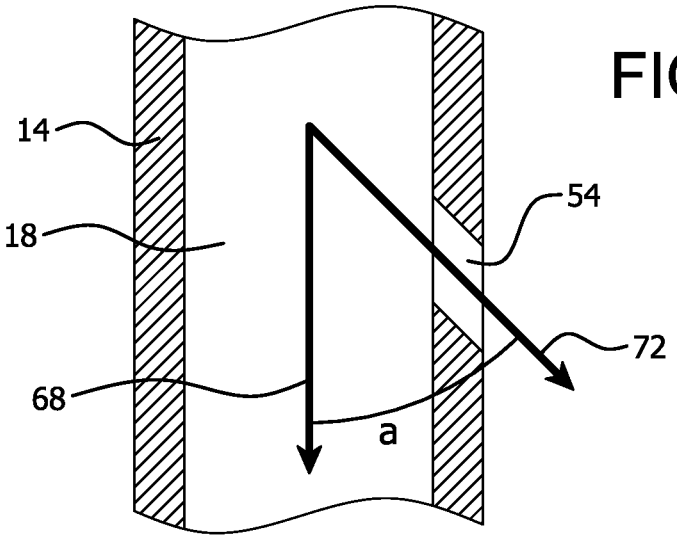
FIG. 1B is a cross section taken along line 1B-1B in FIG. 1.
Figure 1C:
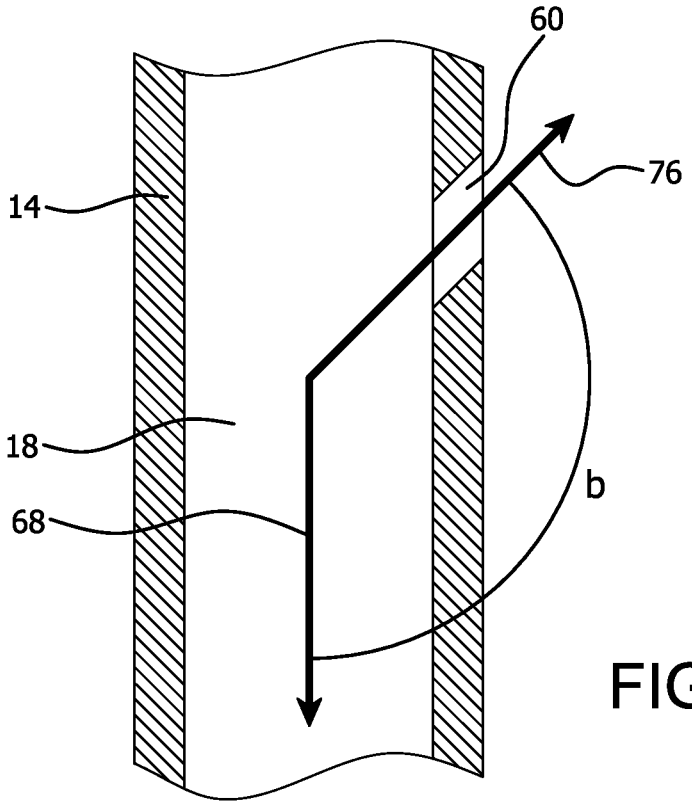
FIG. 1C is a cross section taken along line 1C-1C in FIG. 1B.

As shown in FIG. 1B, the outlet opening 54 is angled relative to the water flow axis 68 of the fill tube 14. The flow direction out of the outlet 54, as shown by arrow 72, is angle "a". A straight radially directed hole could also be used at this location, as it will help hold the diffuser open and have longer contact with the diffuser wall, with more shear forces to slow the flow. The outlet openings nearest the plug end 26 such as outlet 60 shown in FIG. 1C, flow in a different direction. The flow direction, indicated by arrow 76 makes an angle "b" with respect to the axis 68 of the fill tube 14. This angle is toward the inlet end 22 of the fill tube 14, and provides an outwardly directed force to maintain the flexible body 34 in an expanded condition.

Figure 1D:
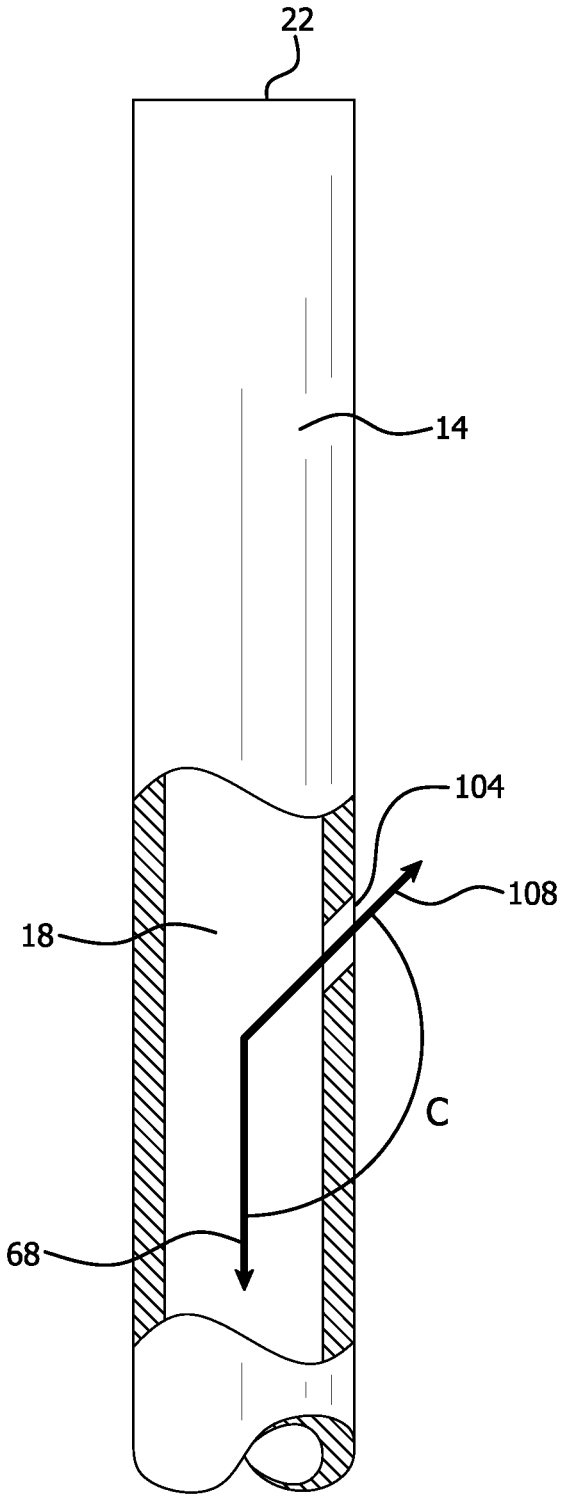
FIG. 1D is an enlargement of area 1D in FIG. 1.

As shown in FIG. 1D, the fill tube 14 can include an antisiphon opening 104 allowing water to escape from the fill tube 14 in the invent of a siphon condition. The antisiphon opening 104 is angled with respect to the water flow axis 68 of the fill tube 14, as indicated by arrow axis 108 and angle "c". It can be seen that in the normal operating state water flowing through the fill tube 14 will largely bypass the antisiphon opening 104, decreasing the mixing of cold water flowing through the fill tube 14 with hot water at the top of the tank. In a siphon condition the antisiphon opening 104 will allow water to flow from the antisiphon opening to prevent the siphoning of water from the water heater.

Figure 2:
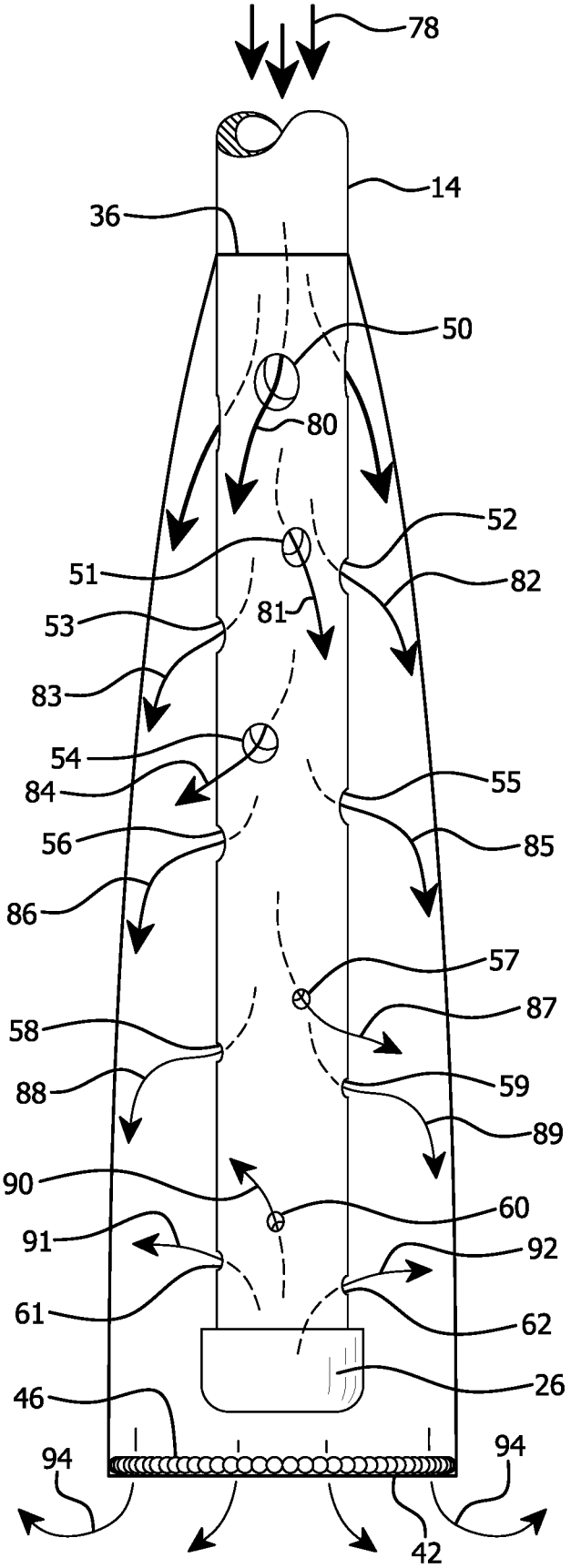
FIG. 2 is a schematic diagram depicting water flows through a diffuser of the invention.

The flow from fill tube water outlet openings 50-62 is illustrated in FIG. 2. The flow through fill tube water outlet openings 50-62 is indicated by arrows 80-92, respectively. The water flowing into the diffuser body 34 is directed toward the outlet end 42 and leaves as indicated by arrows 94. As the size of the fill tube water outlet openings 50-62 decreases toward the outlet end 26, the water volume flowing through these openings also decreases toward the outlet end cap 26.

Figure 3:
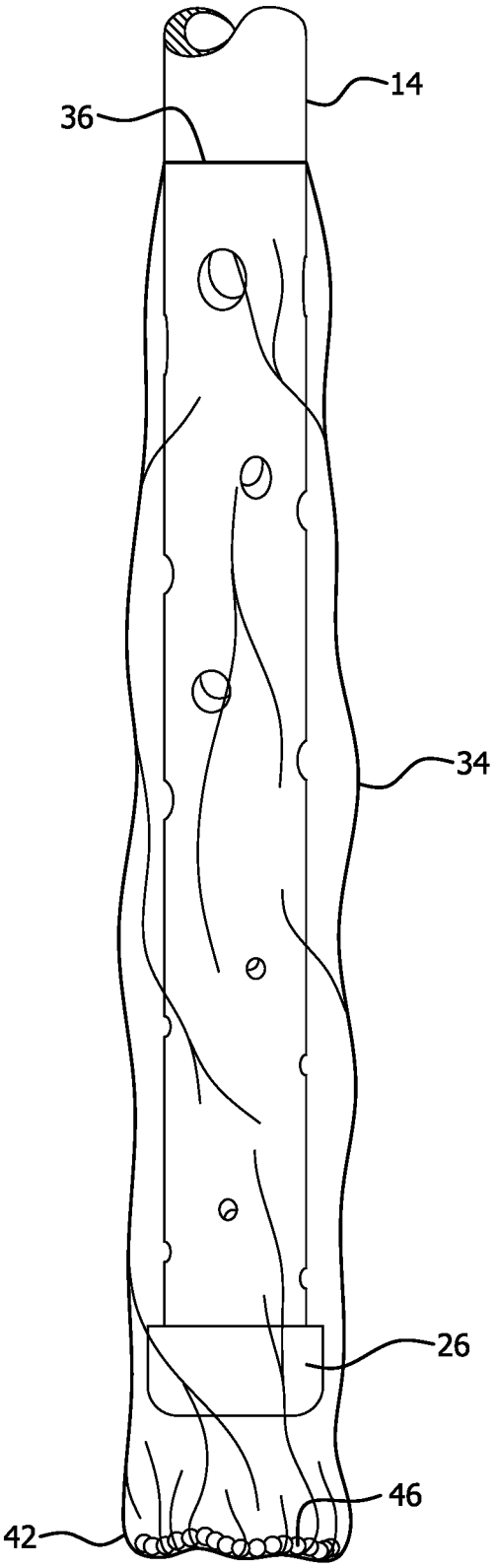
FIG. 3 is a side elevation of the diffuser of the invention in a collapsed state over a fill tube.
Figure 4A:
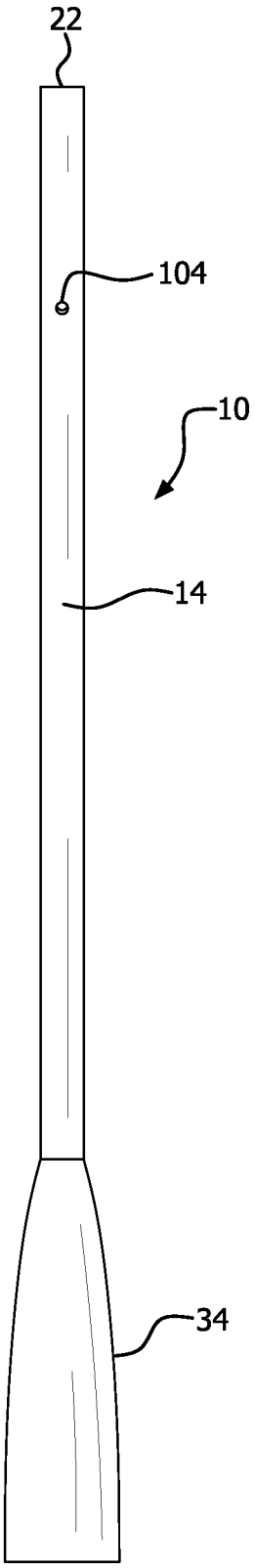
FIG. 4A is a side elevation of a fill tube assembly with a diffuser in an expanded state.
Figure 4B:
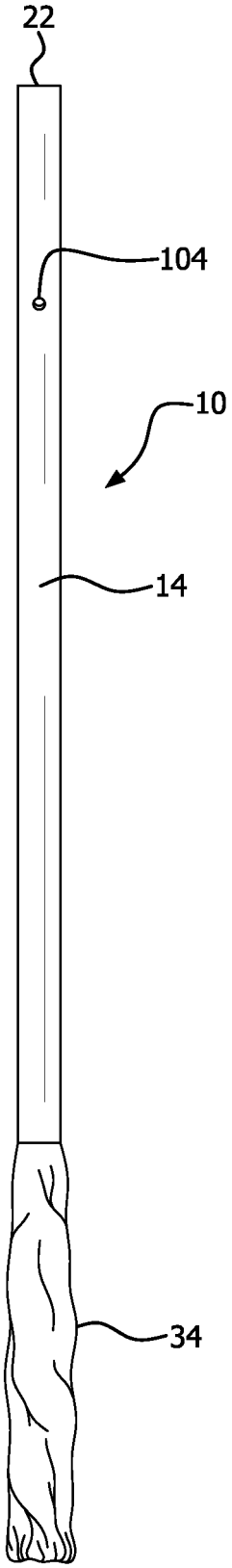
FIG. 4B is a side elevation of a fill tube assembly with a diffuser in a collapsed state.

There is shown in FIG. 3 the flexible body in the contracted position which occurs when no water is flowing from the fill tube 14. There is shown in FIG. 4A the fill tube assembly 10 in the expanded condition and in FIG. 4B in the contracted condition.

Figure 5:
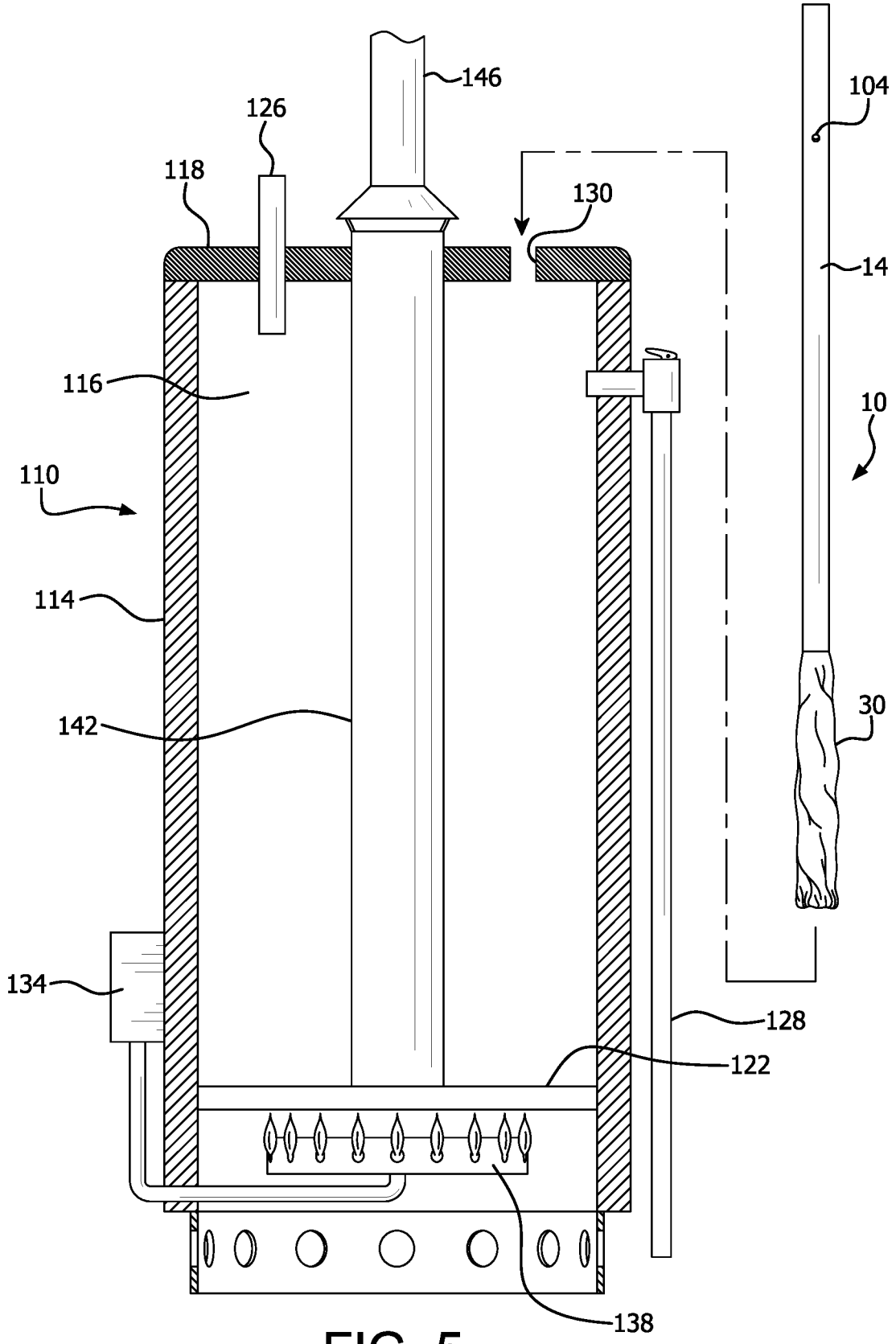
FIG. 5 is a side elevation, partially in cross-section and partially exploded, of a gas water heater with a fill tube assembly in a first mode of installation.
Figure 6:
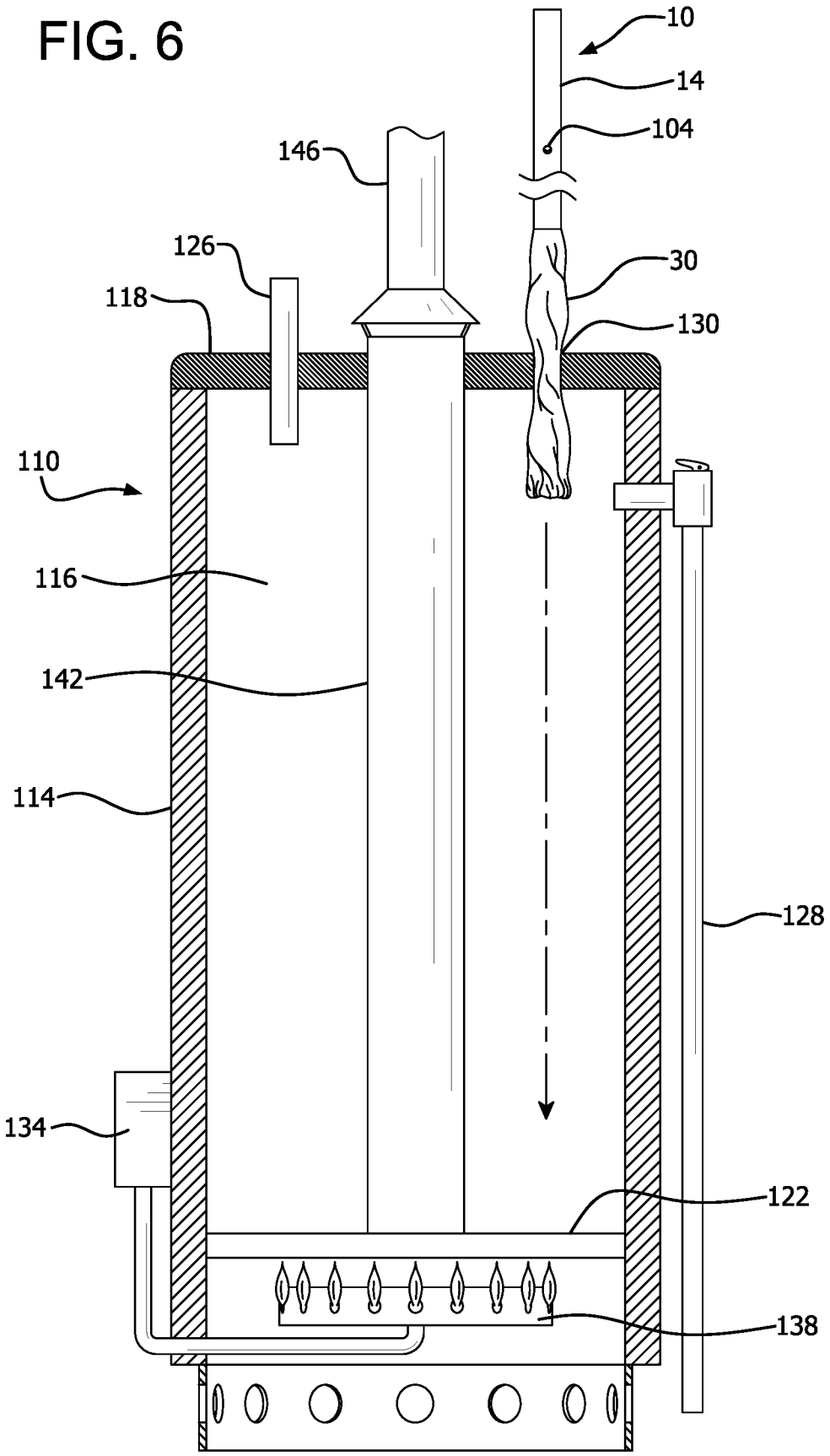
FIG. 6 is a side elevation, partially in cross-section and partially broken away, of a gas water heater with a fill tube assembly in a $2^{nd}$ mode of installation.
Figure 7:
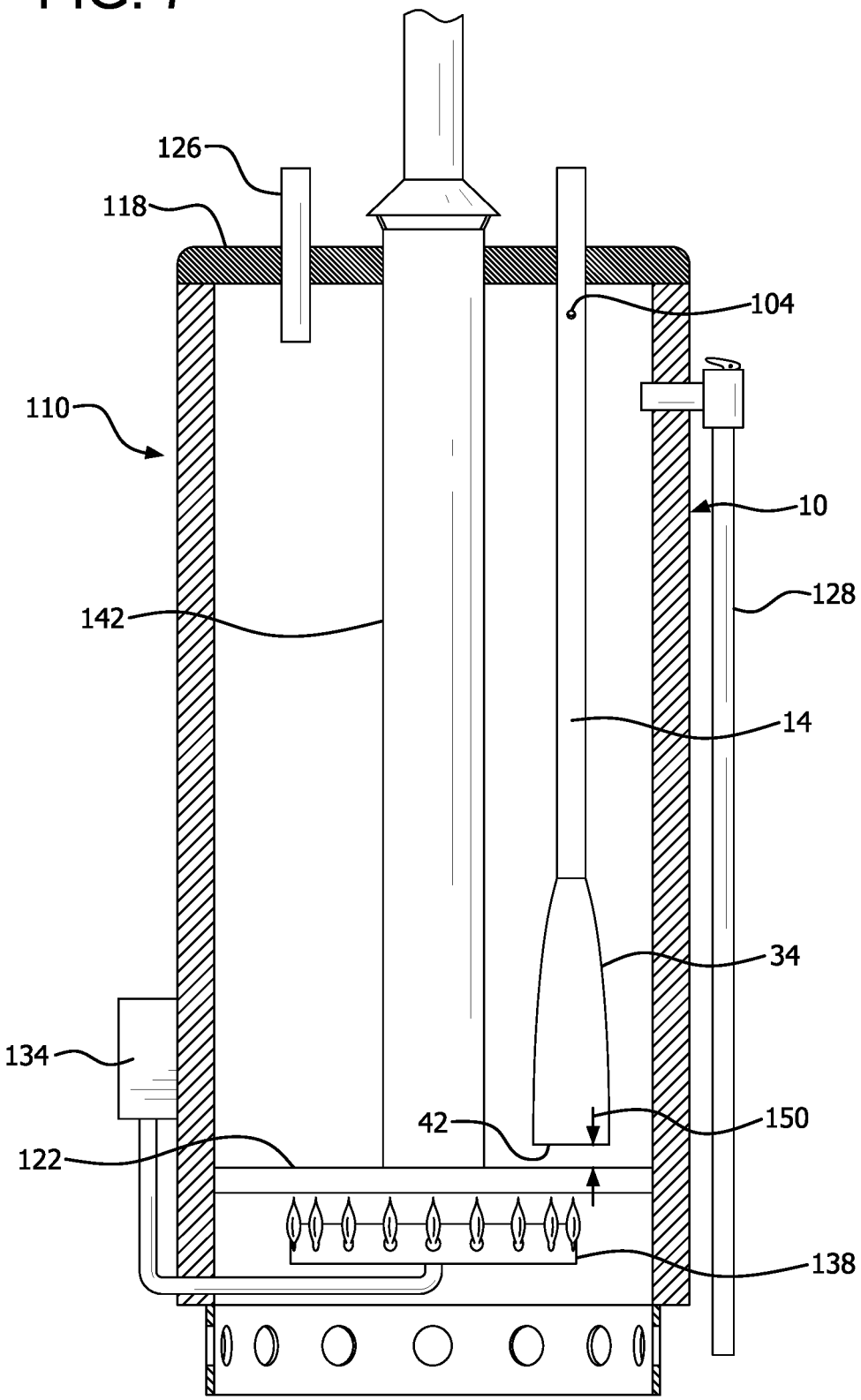
FIG. 7 is a side elevation, partially in cross-section and partially broken away, of a gas water heater with a fill tube assembly in a $3^{rd}$ mode of installation.

There is shown in FIG. 5 a water heater 110 with a tank 114, a top 118 and bottom 122. The water heater 110 can have a water outlet 126. A pressure/temperature relief valve 128 can be provided. The fill tube assembly 10 is placed into the tank 114 through an opening 130 by contracting the diffuser 30, manually or with the aid of a tool, into the contracted state as shown. A source of natural gas 134 can supply burners 138 and fumes can escape from the gas flue 142 and exhaust pipe 146. As shown in FIG. 6, the fill tube assembly 10 is positioned through the aperture 130 into the open interior 116 of the tank 114 by manually contracting the diffuser 30 and positioning it in the aperture 130. As shown in FIG. 7, the fill tube assembly 10 is secured in position with the bottom 42 of the diffuser body 34 a distance shown by arrows 150 from the bottom 122 of the water heater 110. In one embodiment, the longest distance from the diffuser water outlet opening to a bottom of the tank is between $\pi D_D/4$ and $\pi D_D/2$, where $D_D$ is the diameter of the open end of the diffuser.

Figure 8:
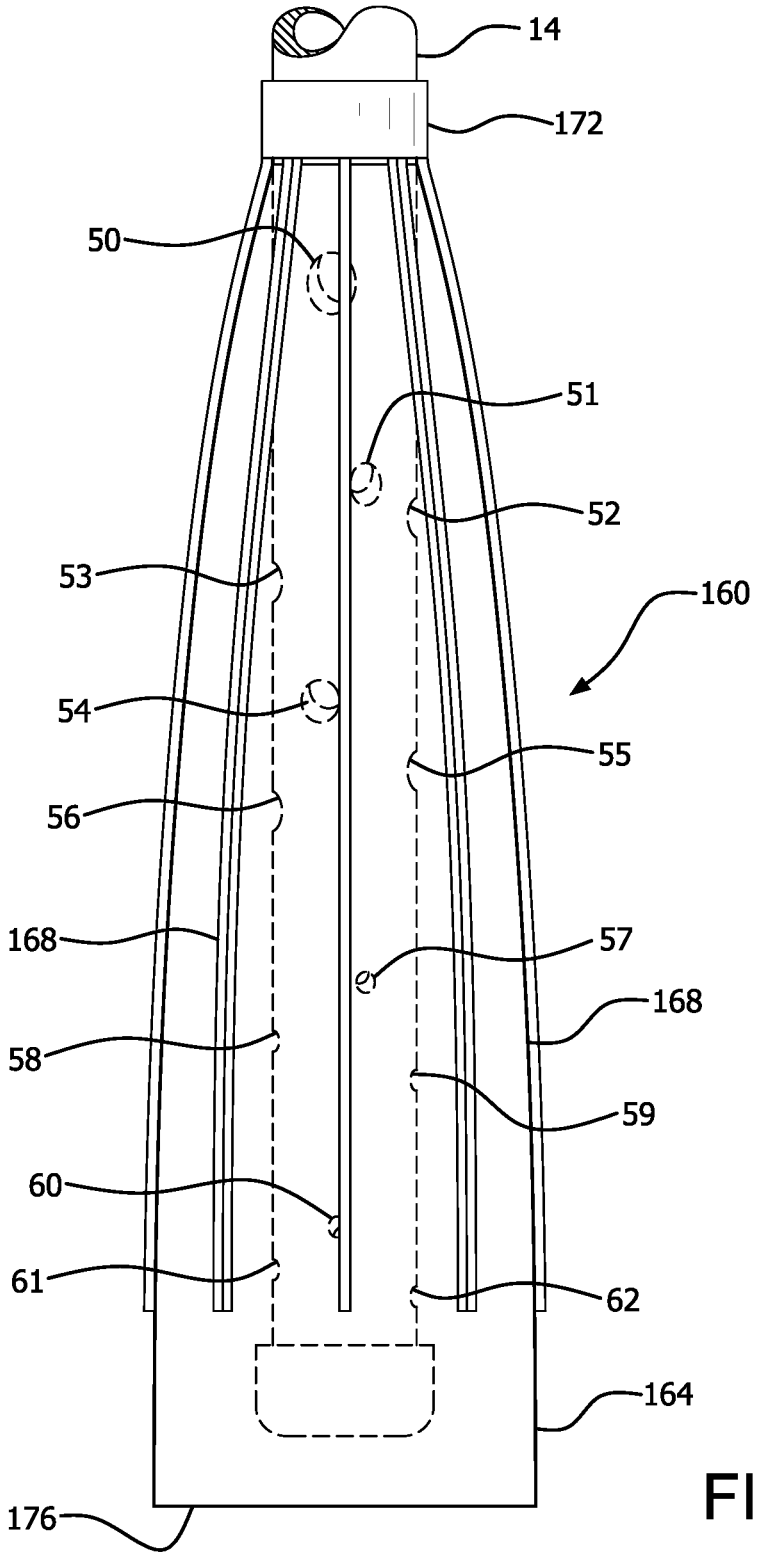
FIG. 8 is a side elevation of the outlet end of a fill tube assembly with an alternative diffuser design.
Figure 9:
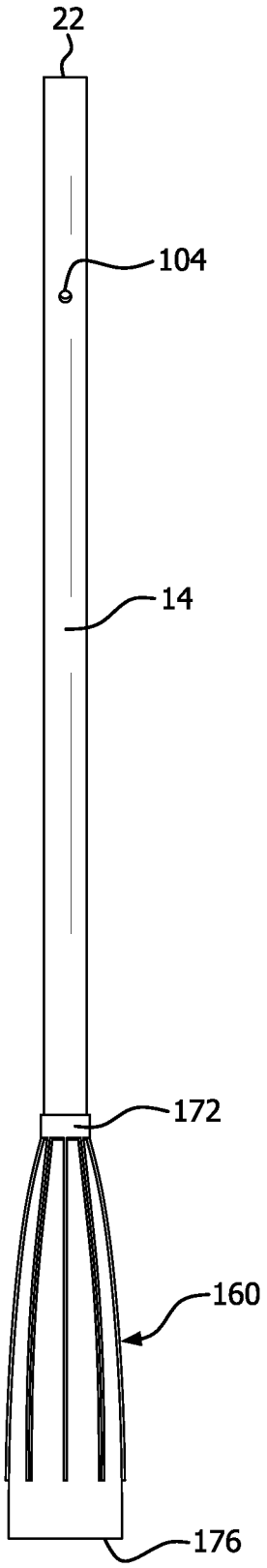
FIG. 9 is a side elevation of a fill tube assembly with an alternative diffuser design, in an expanded state.
Figure 10:
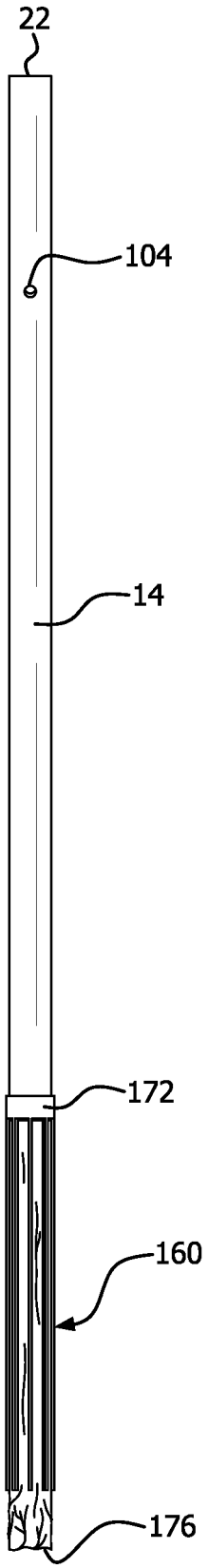
FIG. 10 is a side elevation of a fill tube assembly with an alternative diffuser design, in a collapsed state.
Figure 11:
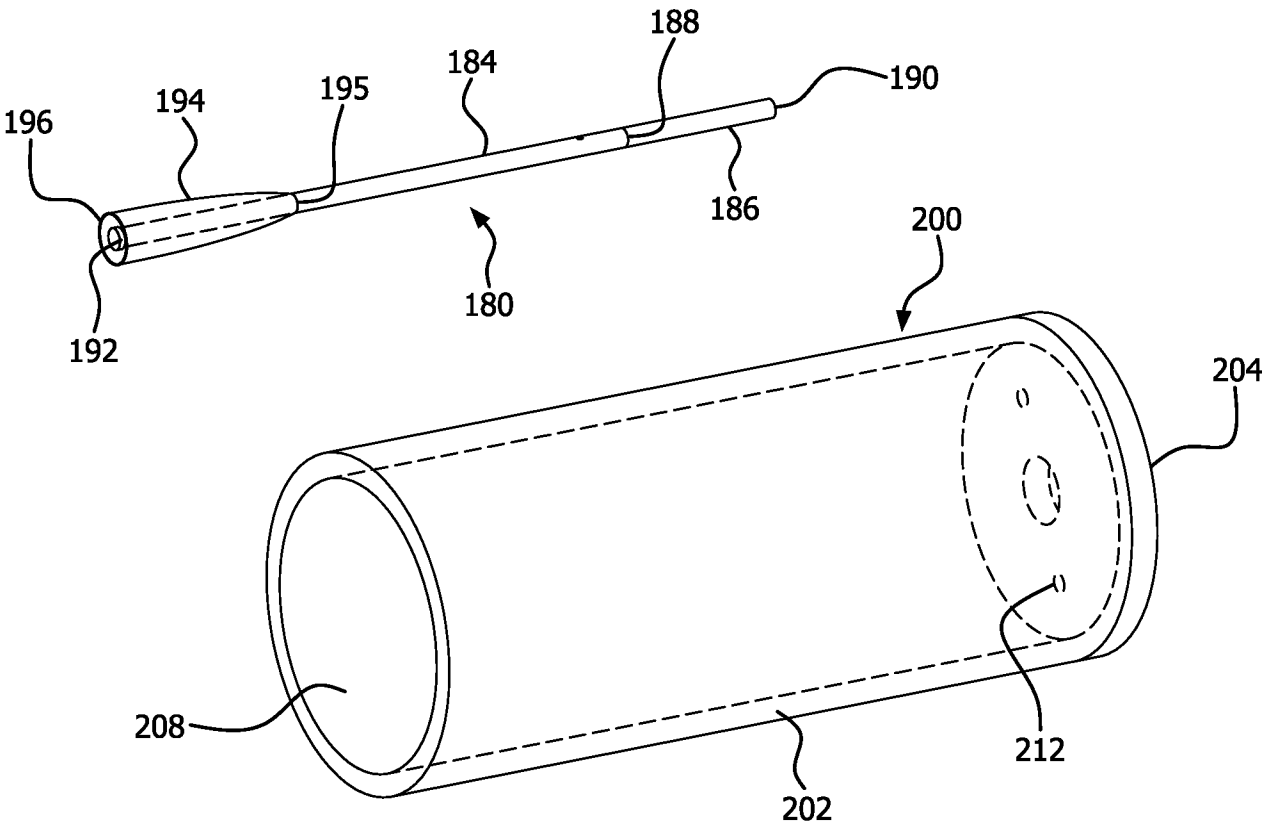
FIG. 11 is a perspective view, partially in phantom, of an alternative fill tube assembly and water heater tank in a first stage of manufacture.

There is shown in FIG. 8 an alternative embodiment of the diffuser 160 which has a flexible diffuser body 164 that is lined with a plurality of radially directed ribs 168. The ribs 168 are secured at a collar 172 which is in turn sealed to the fill tube 14. The ribs 168 are less flexible than the flexible body 164, and are sufficiently elastic to hold the end 176 of the flexible body 164 in an expanded condition such that water flowing from the fill tube openings 50-62 can escape through the diffuser water outlet opening. The turn into the diffuser 160 is shown on a fill tube 14 in an expanded condition in FIG. 9, and in a contracted position in FIG. 10 such as would be used to place the fill tube 14 and diffuser 160 into a water tank through a small opening.

In some current manufacturing methods of making water heaters, the water heater tank is first internally coated with an anticorrosion coating and baked at high temperature prior to completion of the tank. The invention can be used in such water heater tanks and manufacturing methods, and one embodiment is shown in FIGS. 11-15. The fill tube assembly 180 includes a first portion 184 and second portion 186 joined by a juncture 188. The juncture 188 can be provided by cooperatives threads or other connections. The fill tube has an inlet end 190 and an outlet end 192. A diffuser 194 has a sealing end 195 an open end 196 forming a diffuser water outlet opening.

The water heater 200 includes a tank wall 202 and a top 204 and open bottom 208. It is through the open bottom 208 that the anticorrosion coating is applied to the interior of the tank 202. A fill tube opening 212 is provided in the top 204 for connecting a fill tube and the water inlet to the tank 200.

Figure 12:
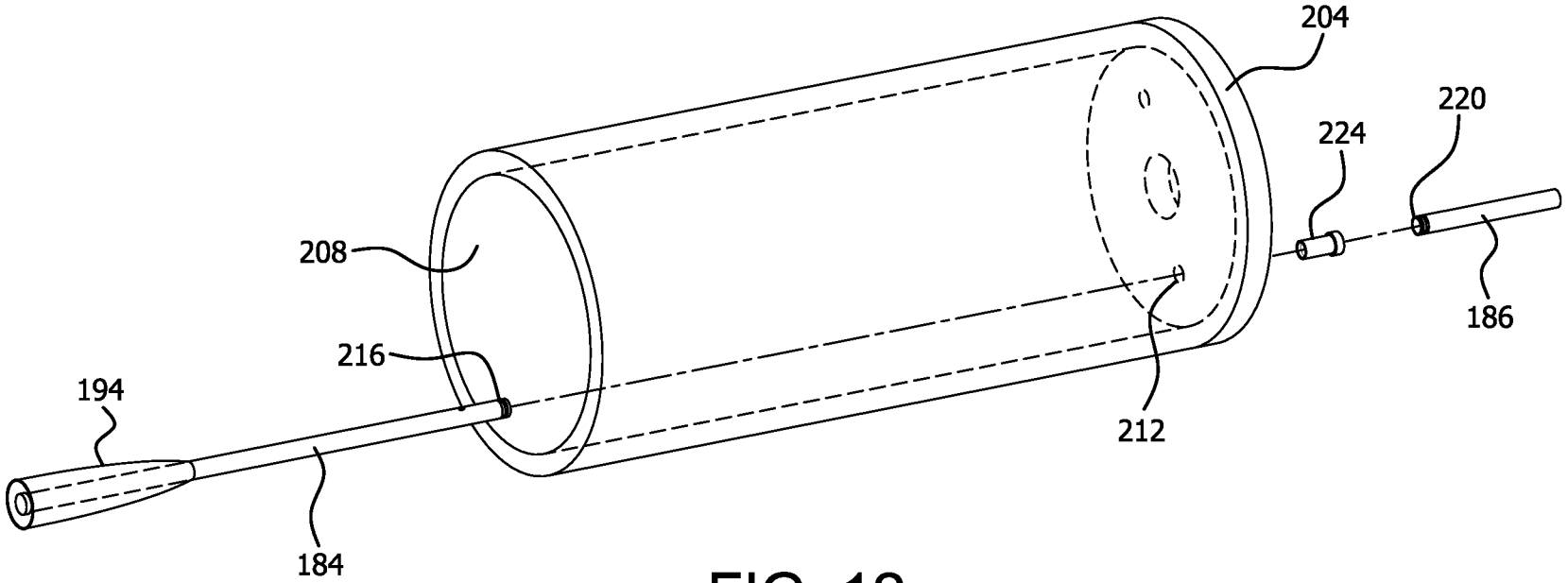
FIG. 12 is an exploded perspective view, partially in phantom, of an alternative fill tube assembly and water heater tank in a second stage of manufacture.
Figure 13:
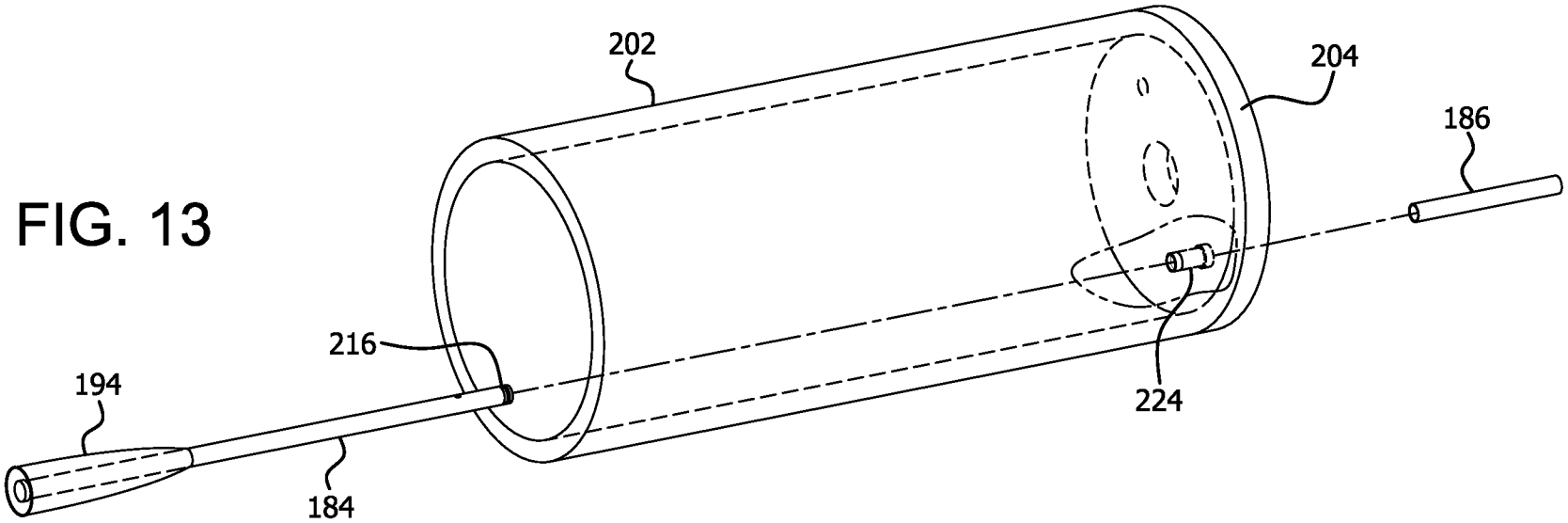
FIG. 13 is an exploded perspective view, partially in phantom, of an alternative fill tube assembly and water heater tank in a third stage of manufacture.
Figure 14:
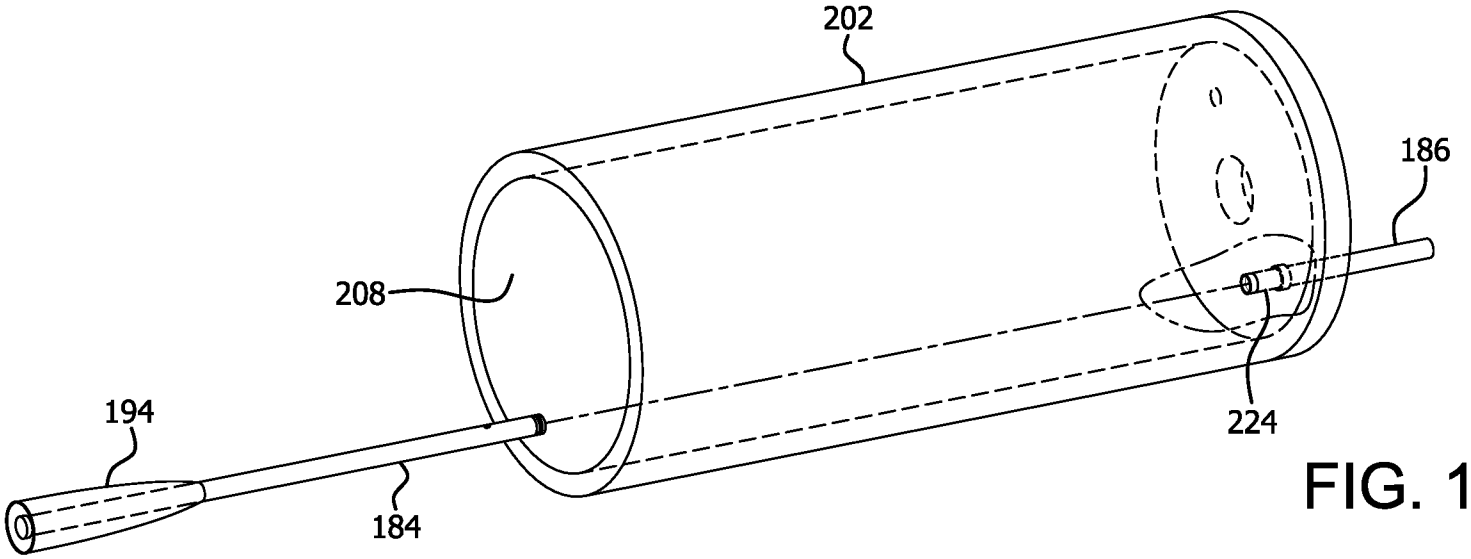
FIG. 14 is an exploded perspective view, partially in phantom, of an alternative fill tube assembly and water heater tank in a fourth stage of manufacture.
Figure 15:
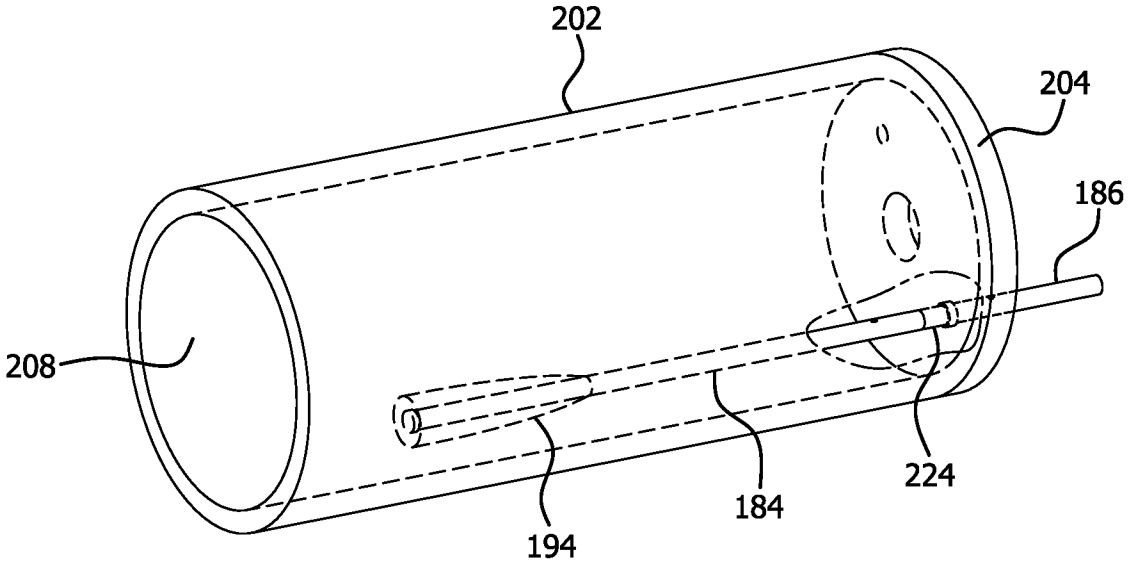
FIG. 15 is a perspective view, partially in phantom, of an alternative fill tube assembly and water heater tank in a fifth stage of manufacture.

As shown in FIG. 12, the first portion 184 and second portion 186 can be connected to the tank 202 and top 204 by a locking collar 224. As shown in FIG. 13 the locking collar 224 can be secured in the opening 212 by threads or other securing methods. As shown in FIG. 14, the second portion 186 can then be secured to the locking collar 224. As shown in FIG. 15, the second portion 184 with the diffuser 194 is placed through the open end 208. Threads 216 on the second portion 184 are connected to threads 220 on the first portion 186 to secure the fill tube assembly in position. The first portion 184 and second portion 186 can be attached directly to one another, or individually attached to the collar 224. The diffuser 194 need not be flexible in this embodiment as it is introduced through the large opening 208 at the bottom of the tank 202. However, by making the diffuser 194 flexible it will be possible to remove the fill tube assembly through the opening 212 in the event replacement is necessary.

Figure 16:
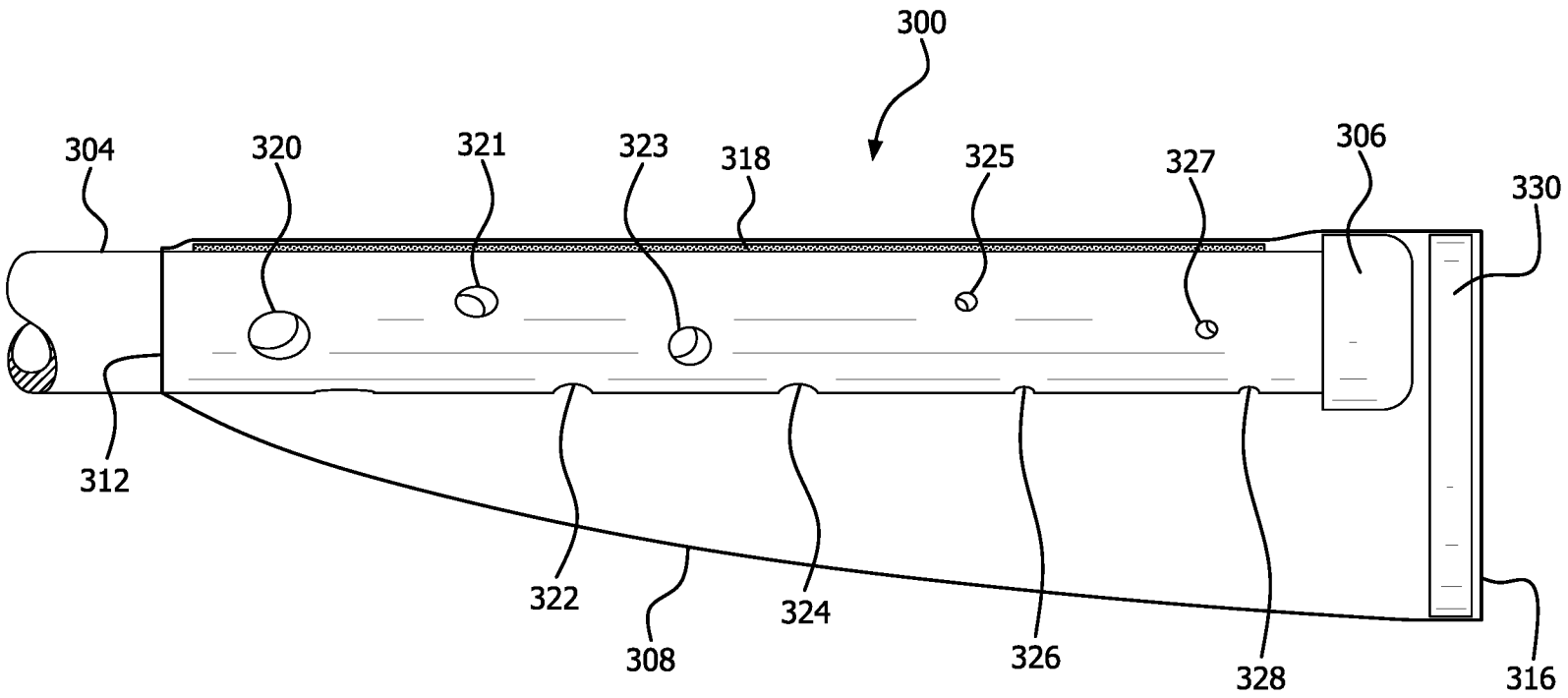
FIG. 16 is a side elevation of the outlet and of a side mounted fill tube assembly.
Figure 17:
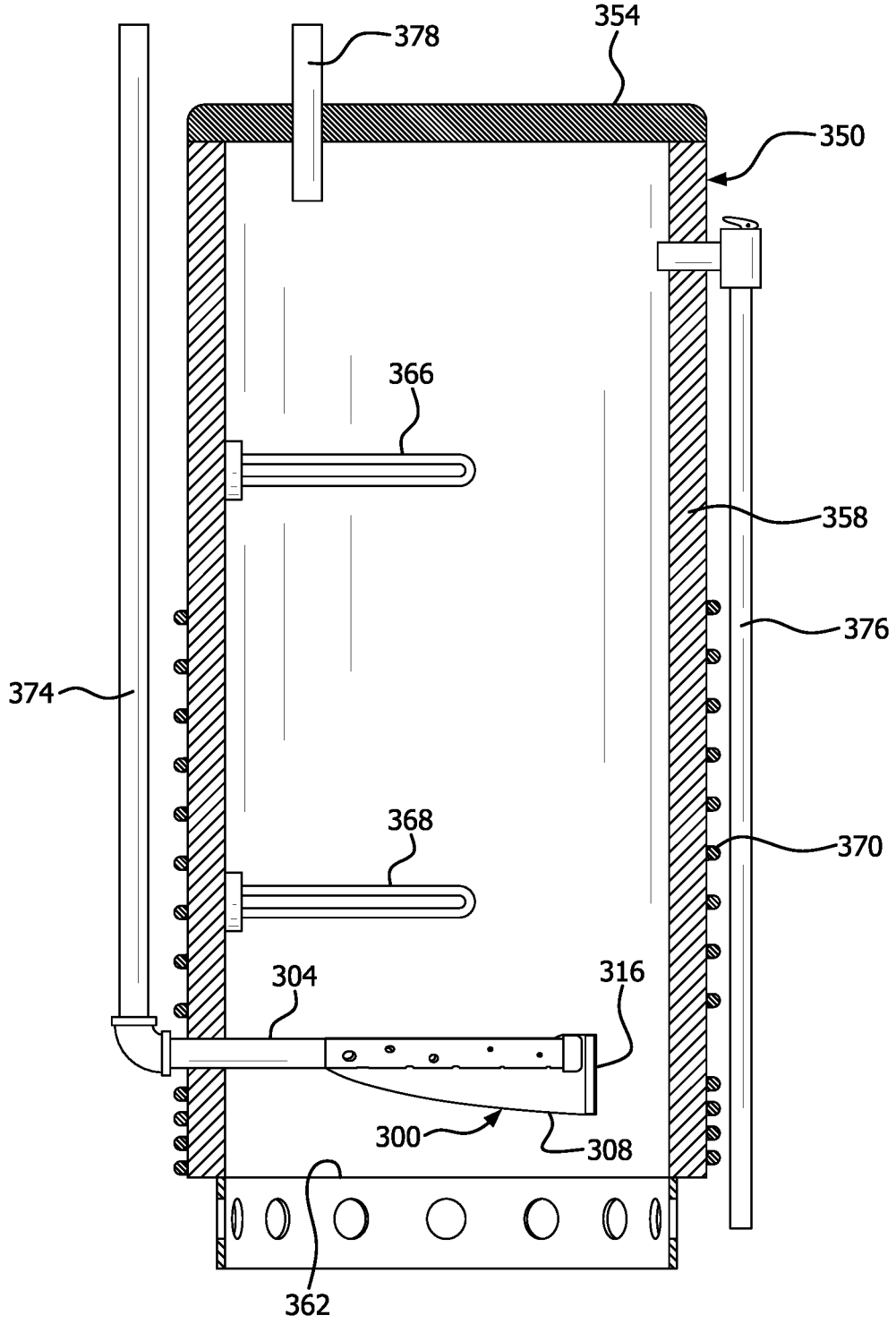
FIG. 17 is a cross-section of an electric heat-pump water heater with the side mounted fill tube assembly that includes the condenser coil of a heat pump that supplies heat to the tank as well as the electric elements.

Some water heaters have water inlet at the side of the tank and not at the top. A fill tube assembly 300 for such water tanks is shown in FIGS. 16-17. A fill tube 304 has an outlet end 306 and a diffuser 308 which is sealed at and 312 to the fill tube 304. In this embodiment, one side of the diffuser 308 is joined by an elongated seam 318 to the fill tube 304. An open end 316 of the diffuser 308 is insignificant part below the fill tube 304 as shown. An elastic band 330, a half ring of weights similar to 42 or other structure can be used to maintain the open end 316 of the diffuser 308 in an expanded condition. Fill tube water outlet openings 320-328 will expel water and also maintain the diffuser body 308 in the expanded condition. The fill tube water outlet openings 320-328 can have a reduced diameters in the direction of the outlet end 306

This embodiment of the invention is shown in an electric heat pump water heater 350 in FIG. 17. The water heater 350 has a top 354, bottom 362 and side wall 358. The water heater 350 includes electric heating elements 366 and 368. A water inlet 374 communicates with the fill tube 304. A hot water outlet 378 is provided in the top 354. A condenser coil 370 can be provided around the wall 358 to serve as a heat source when connected to an external heat pump. A pressure temperature relief valve 376 can be provided.

Figure 18:
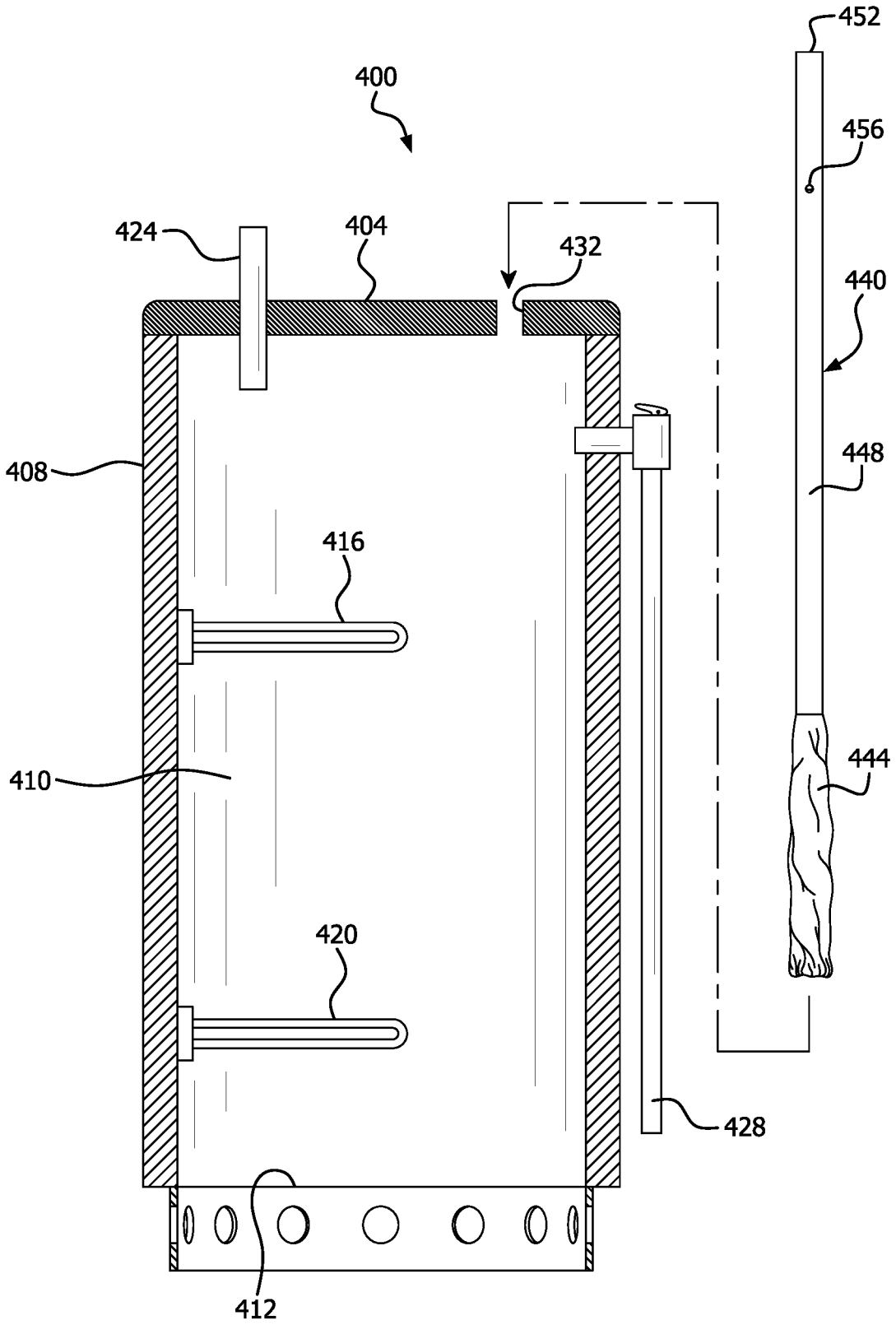
FIG. 18 is an exploded side elevation, partially in cross-section of an electric water heater and top mounted fill tube assembly in an initial stage of installation and with the diffuser in a collapsed state.
Figure 19:
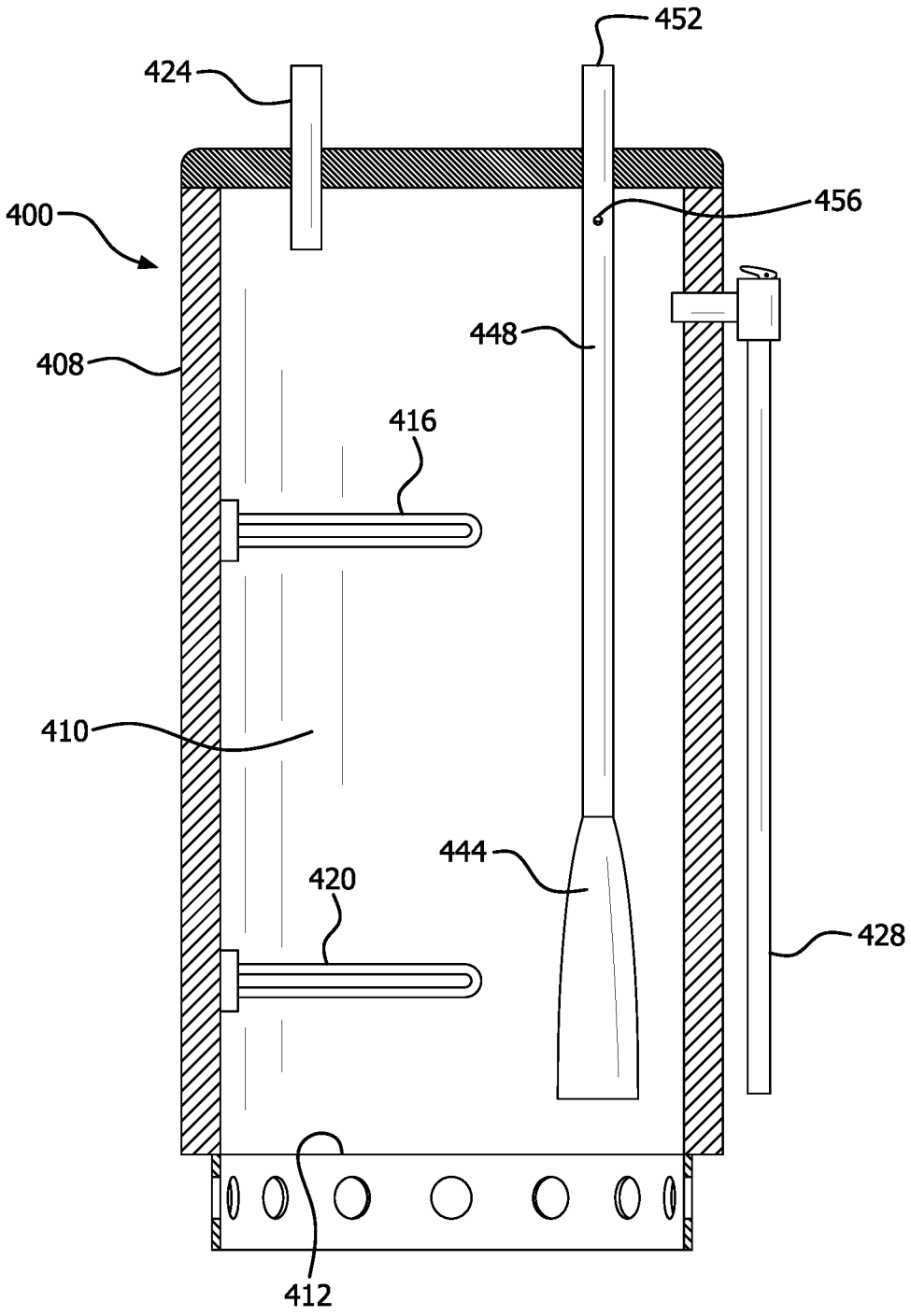
FIG. 19 is a cross-section of an electric water heater and top mounted fill tube assembly in a final stage of installation and with the diffuser in an expanded state.

There is shown in FIGS. 18-19 a electric water heater 400. The water heater 400 has a top 404, sides 408 and bottom 412. Electric heating elements 416 and 420 are provided in the open interior 410 of the water heater 400. A hot water outlet 424 is provided. A pressure/temperature relief valve 428 can be provided. A connection opening 432 is provided for placement of a fill tube.

A fill tube assembly 440 according to the invention includes a fill tube 448, diffuser 444, a water inlet end 452 and antisiphon opening 456. The fill tube assembly 420 is placed through the opening 432 as shown in FIG. 18. Upon placement within the tank interior 410 the diffuser body 444 will expand as shown in FIG. 19.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alternations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A fill tube assembly for a water heater, comprising:

an elongated fill tube having an interior water flow axis and a tube wall with an inlet end and an outlet end, and an open interior communicating with a water inlet opening at the inlet end and with at least one fill tube water outlet opening in the tube wall for directing water radially outward from the elongated fill tube;

an elongated flexible diffuser body at the outlet end of the elongated fill tube, the elongated flexible diffuser body sealing with an outside surface of the tube wall at a sealing end closest to the inlet end of the elongated fill tube, and having an open end at which is an end closest to the outlet end of the elongated fill tube, the open end having a diameter larger than an outside diameter of the tube wall, thereby creating a diffuser water outlet opening between the elongated flexible diffuser body and the tube wall for redirecting radial water flow emanating from the at least one fill tube water outlet opening toward the diffuser water outlet opening; and, further comprising a plurality of flexible ribs spaced apart on the elongated flexible diffuser body, the plurality of flexible ribs having an elasticity less than an elasticity of the elongated flexible diffuser body.

2. The fill tube assembly of claim 1, wherein the elongated flexible diffuser body is conical.

3. The fill tube assembly of claim 1, wherein the elongated fill tube comprises a plurality of fill tube water outlet openings axially spaced apart at the outlet end of the elongated fill tube, the fill tube water outlet openings decreasing in diameter toward the outlet end of the elongated fill tube.

4. The fill tube assembly of claim 3, wherein the fill tube water outlet openings have an axis between 10 and 80 degrees to the water flow axis of the elongated fill tube.

5. The fill tube assembly of claim 4, wherein the fill tube water outlet openings are oriented distally toward the outlet end of the elongated fill tube and diffuser water outlet opening.

6. The fill tube assembly of claim 5, wherein fill tube water outlet openings nearest the outlet end of the fill tube are oriented between 90 and 170 degrees relative to the interior water flow axis of the elongated fill tube.

7. The fill tube assembly of claim 3, comprising a plurality of the fill tube water outlet openings, and wherein a distance from a fill tube water outlet openings to the elongated flexible diffuser body decreases with a distance of the respective fill tube water outlet opening from the outlet end of the elongated fill tube.

8. The fill tube assembly of claim 1, wherein the elongated fill tube comprises an antisiphon water outlet opening at the inlet end of the elongated fill tube, the antisiphon water outlet opening having an axis, the axis of the antisiphon water outlet opening being between 100 and 170 degrees to the interior water flow axis of the elongated fill tube.

9. The fill tube assembly of claim 1, wherein the sealing end of the elongated flexible diffuser body comprises a detachable connection to the elongated fill tube.

10. The fill tube assembly of claim 9, wherein the detachable connection is an elastic band.

11. The fill tube assembly of claim 1, wherein the sealing end comprises a fastener for affixing the sealing end to the elongated fill tube.

12. The fill tube assembly of claim 1, wherein the diffuser water outlet opening is annular.

13. The fill tube assembly of claim 1, further comprising an attachment seam between the elongated fill tube and the elongated flexible diffuser body, the attachment seam being elongated and extending longitudinally down the elongated fill tube.

14. The fill tube assembly of claim 1, wherein the elongated flexible diffuser body comprises shape memory high temperature silicone.

15. The fill tube assembly of claim 1, wherein the outlet end of the elongated fill tube is plugged.

16. The fill tube assembly of claim 1, wherein the outside diameter of the diffuser water outlet opening is 1.5 to 20 times larger than the diameter of the elongated fill tube.

17. The fill tube assembly of claim 1, wherein the elongated fill tube comprises between 1 and 20 fill tube water outlet openings.

18. The fill tube assembly of claim 17, wherein a sum of the cross sectional areas of the water outlet openings is larger than the cross sectional area of the open interior of the elongated fill tube.

19. A water heater, comprising:

a tank having a top, bottom and sides, with a tank water inlet and a tank water outlet;

an elongated fill tube connected to the tank water inlet and having an interior water flow axis and a tube wall with an inlet end and an outlet end, and an open interior communicating with a water inlet opening at the inlet end and at least one fill tube water outlet opening in the tube wall for directing water radially outward from the elongated fill tube;

an elongated flexible diffuser body at the outlet end of the elongated fill tube, the elongated flexible diffuser body sealing with an outside surface of the tube wall at an end closest to the inlet end of the elongated fill tube, and having an open end which is an end closest to the outlet end of the elongated fill tube, the open end having a diameter larger than an outside diameter of the tube wall, thereby creating a diffuser water outlet opening between the elongated flexible diffuser body and the tube wall for redirecting radial water flow emanating from the at least one fill tube water outlet opening toward the diffuser water outlet opening; and, further comprising a plurality of flexible ribs spaced apart on the elongated flexible diffuser body, the plurality of flexible ribs having an elasticity less than an elasticity of the elongated flexible diffuser body.

20. The water heater of claim 19, wherein a longest distance from the diffuser water outlet opening to a bottom of the tank is between $\pi D_D/4$ and $\pi D_D/2$, where $D_D$ is the diameter of the open end of the elongated flexible diffuser body.

21. A method of heating water, comprising the steps of:

providing a water heater according to claim 19;

supplying water to the water heater through the tank water inlet and the elongated fill tube, wherein water will emerge from the elongated fill tube and be directed by the elongated flexible diffuser body to the diffuser water outlet opening; and, removing heated water from the tank water outlet.

22. The method of claim 21, further compromising the step of removing the fill tube from the water heater, placing the diffuser onto the fill tube adjacent the outlet end, flexing the diffuser body to a contracted state, and placing the fill tube and the diffuser into the water heater tank.

23. The method of claim 21, further compromising the step of removing an existing water heater fill tube from the water heater, providing the fill tube with the elongated flexible diffuser body, flexing the elongated flexible diffuser body to a contracted state, and placing the fill tube and the elongated flexible diffuser body into the water heater tank.

24. A diffuser for a water heater fill tube having a tube wall with an outside diameter, the diffuser comprising an elongated flexible diffuser body for positioning at an outlet end of the water heater fill tube, the elongated flexible diffuser body having a sealing end opening for mating and sealing with an outside surface of the tube wall at a sealing end closest to an inlet end of the water heater fill tube, and having an open end for positioning the open end closest to the outlet end of the water heater fill tube, the open end having a diameter larger than an outside diameter of the tube wall, thereby creating a diffuser water outlet opening between the elongated flexible diffuser body and the tube wall for redirecting radial water flow emanating from the water heater fill tube water outlet opening toward the diffuser water outlet opening; and, further comprising a plurality of flexible ribs spaced apart on the elongated flexible diffuser body, the plurality of flexible ribs having an elasticity less than an elasticity of the elongated flexible diffuser body.

* * * * *